US010561998B2

(12) United States Patent
Buesch et al.

(10) Patent No.: US 10,561,998 B2
(45) Date of Patent: Feb. 18, 2020

(54) STIRRING STAFF ARRANGEMENT AS WELL AS TRANSPORT AND STORAGE CONTAINER FOR LIQUIDS HAVING A STIRRING STAFF ARRANGEMENT

(71) Applicant: PROTECHNA S.A., Fribourg (CH)

(72) Inventors: Carsten Buesch, Altenkirchen (DE); Peter Bloemer, Hennef (DE); Ulrich Paul, Ransbach-Baumbach (DE)

(73) Assignee: PROTECHNA S.A., Fribourg (CH)

( * ) Notice: Subject to any disclaimer, the term of this patent is extended or adjusted under 35 U.S.C. 154(b) by 143 days.

(21) Appl. No.: 15/556,000

(22) PCT Filed: Jan. 26, 2016

(86) PCT No.: PCT/EP2016/051497
§ 371 (c)(1),
(2) Date: Sep. 6, 2017

(87) PCT Pub. No.: WO2016/142090
PCT Pub. Date: Sep. 15, 2016

(65) Prior Publication Data

US 2018/0056257 A1 Mar. 1, 2018

(30) Foreign Application Priority Data

Mar. 11, 2015 (DE) ..... 10 2015 204 394
Jun. 15, 2015 (DE) ..... 10 2015 210 904

(51) Int. Cl.
*B01F 15/00* (2006.01)
*B01F 7/00* (2006.01)

(52) U.S. Cl.
CPC .... *B01F 15/00006* (2013.01); *B01F 7/00033* (2013.01); *B01F 7/00066* (2013.01);
(Continued)

(58) Field of Classification Search
CPC ..... B01F 15/00006; B01F 7/00066; B01F 7/00158; B01F 7/00033; B01F 7/00541; B01F 15/00681; B01F 2215/0422
See application file for complete search history.

(56) References Cited

U.S. PATENT DOCUMENTS 1,898,094 A 2/1933 Nies
3,381,941 A * 5/1968 Gibson ..... B01F 7/00066 366/308
(Continued)

FOREIGN PATENT DOCUMENTS

CA 2644168 5/2010
CN 203555643 U 4/2014
(Continued)

*Primary Examiner* — Anshu Bhatia
(74) *Attorney, Agent, or Firm* — King & Schickli, PLLC

(57) ABSTRACT

A stirring staff arrangement (29) for being connected to a stirring machine that can be combined with a container (20) for receiving liquids, wherein the container, in an upper bottom wall (26), has a filling opening being closable with the help of a lid (28) for filling the container, wherein the stirring staff arrangement has a bar-shaped stirrer element carrier (30) embodied as a hollow shaft for receiving a stirring machine shaft, and stirrer elements (32) coupled to the stirrer element carrier so as to be pivotable, in such a manner that the stirrer elements have been pivoted, in a mounting configuration, with a free stirrer element end, against an axis of rotation of the stirrer element carrier, wherein a spring means is arranged between the stirrer elements and the stirrer element carrier, in such a manner that the stirrer elements, in an operating configuration, are charged with centrifugal force as a consequence of a rotation of the stirrer element carrier and take a pivoted position that depends on the rotational speed of the stirrer element carrier, a stirring angle δ being realized with respect to the axis of rotation, wherein the free stirrer element ends are arranged
(Continued)

at a stirring distance r from the axis of rotation and the spring force, which increases as the stirring angle grows, opposes the centrifugal force.

40 Claims, 6 Drawing Sheets

(52) U.S. Cl.
CPC ..... *B01F 7/00158* (2013.01); *B01F 7/00541* (2013.01); *B01F 15/00681* (2013.01); *B01F 2215/0422* (2013.01)

(56) References Cited

U.S. PATENT DOCUMENTS

| | | | | |
|---|---|---|---|---|
| 2004/0145965 | A1 | 7/2004 | Chan et al. | |
| 2005/0239199 | A1* | 10/2005 | Kunas | B01F 7/001 435/297.1 |
| 2007/0036028 | A1 | 2/2007 | Yoshioka | |
| 2018/0056257 | A1 | 3/2018 | Büsch et al. | |

FOREIGN PATENT DOCUMENTS

| | | | |
|---|---|---|---|
| CN | 203556307 | U | 4/2014 |
| DE | 2420605 | | 11/1975 |
| DE | 102010060094 | | 12/2011 |
| DE | 102011051499 | | 1/2013 |
| EP | 0164303 | | 12/1985 |
| EP | 2620210 | | 7/2013 |
| GB | 115933 | | 5/1918 |
| JP | S61143631 | | 9/1986 |
| JP | 3210877 | | 9/2001 |
| KR | 20040052514 | A | 6/2004 |
| KR | 101235514 | B1 | 2/2013 |
| SU | 1152639 | | 4/1985 |
| SU | 1662658 | | 7/1991 |
| WO | WO2016142090 | A2 | 9/2016 |

* cited by examiner

Fig. 10
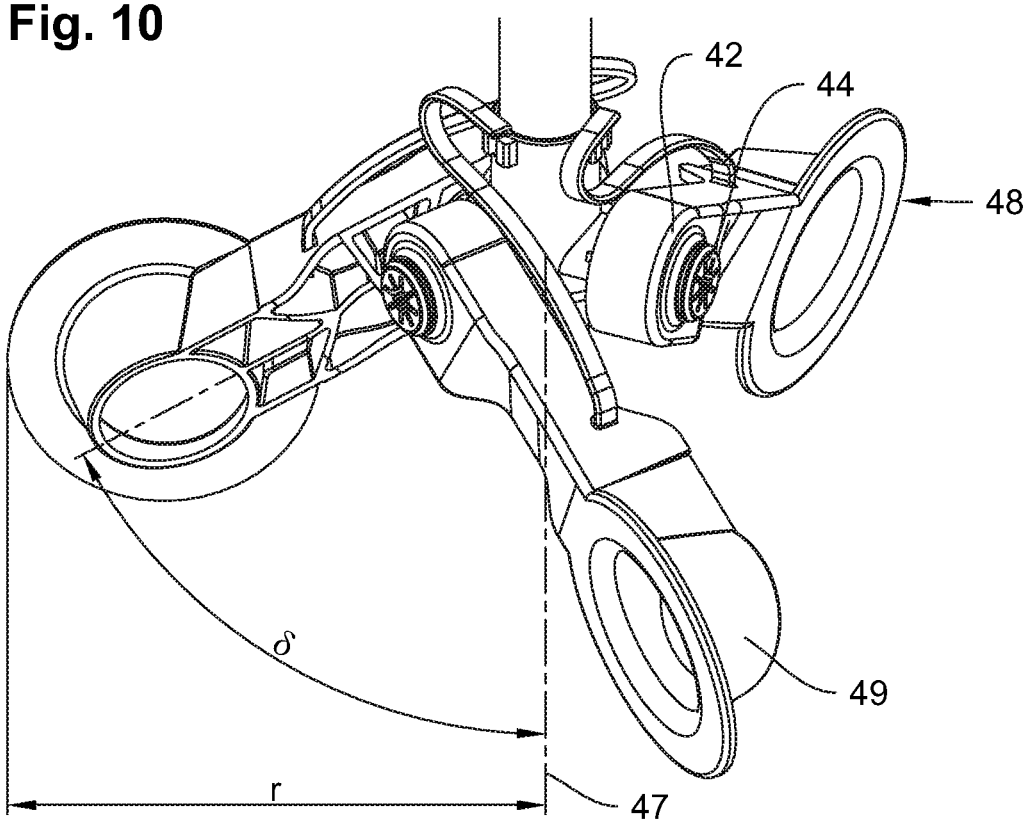
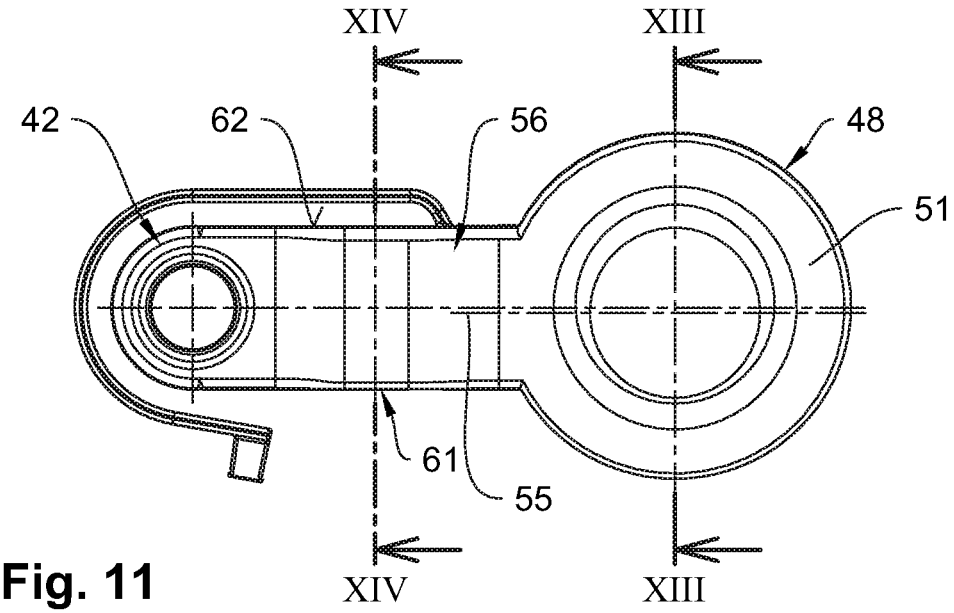
Fig. 11

STIRRING STAFF ARRANGEMENT AS WELL AS TRANSPORT AND STORAGE CONTAINER FOR LIQUIDS HAVING A STIRRING STAFF ARRANGEMENT

FIELD OF THE INVENTION

The invention relates to a stirring staff arrangement for being connected to a stirring machine that can be combined with a container for receiving liquids, wherein the container, in an upper bottom wall, has a filling opening being closable with the help of a lid for filling the container, wherein the stirring staff arrangement has a bar-shaped stirrer element carrier embodied as a hollow shaft for receiving a stirring machine shaft, and stirrer elements coupled to the stirrer element carrier so as to be pivotable, in such a manner that the stirrer elements have been pivoted, in a mounting configuration, with a free stirrer element end, against an axis of rotation of the stirrer element carrier.

BACKGROUND OF THE INVENTION

A stirring staff arrangement of the afore-mentioned type is known from EP 2 620 210 A1. The stirrer elements of the known stirring staff arrangement have been pivoted, in a mounting configuration, in which the stirring staff arrangement may be inserted into a container for receiving liquids, against the stirrer element carrier and are retained at the stirrer element carrier in this position via a snap-lock.

For being conveyed into an operating configuration, in which the stirrer elements, with their stirrer element ends, are situated in a position where they are radially spaced apart from the stirrer element carrier, the stirrer elements have to be pivoted manually.

SUMMARY OF THE INVENTION

The present invention is based on the task of proposing a stirring staff arrangement of the afore-mentioned type, allowing for automatically conveying the stirrer elements from the mounting configuration into the operating configuration.

To solve this task, the stirring staff arrangement in accordance with the invention has the features of claim 1.

In accordance with the invention, a spring means is arranged between the stirrer elements and the stirrer element carrier, in such a manner that the stirrer elements, in an operating configuration, as a consequence of a rotation of the stirrer element carrier, take a pivoted position that depends on the rotational speed of the stirrer element carrier, a stirring angle $\delta$ being realized with respect to the axis of rotation, in such a manner that the free stirrer element ends are arranged at a stirring distance r from the axis of rotation and the spring force increases as the stirring angle grows.

In accordance with the invention, the stirrer elements therefore swing open in an automated fashion, in such a manner that the stirrer element ends, when operating the stirring staff arrangement, as a consequence of the centrifugal force acting on the stirrer element ends, swing open and are arranged at a stirring distance from the axis of rotation. Hereby, it is not only possible to convey the stirrer elements from the mounting configuration into the operating configuration without manual intervention. Additionally, via selecting a suitable torque of the stirring staff arrangement, the desired distance of the stirrer element ends from the stirrer element carrier can be set. The spring force acts as a reset force, which opposes the centrifugal force and brings about a reset of the stirrer element ends against the axis of rotation as the rotational speed decreases. In this way, it is in particular also possible to stir up residual amounts of liquids existing in the container, accumulating in a constricted bottom region of the container, without there being a risk of a collision of the stirrer element ends with the container wall. The resetting resilience also entails that even stirrer elements made of a material of low density cannot float in a liquid of a comparable density, but are operative in a desired stirring depth in the liquid.

It is particularly advantageous if the free stirrer element ends of the stirrer elements, in the mounting configuration, are arranged below pivot bearings embodied at the stirrer element carrier since the stirrer elements can thus, in the mounting configuration, be directly pivoted against one another, such that the cross-section relevant for introducing the stirring staff arrangement through the filling opening of the container into the container becomes as small as possible in the region of the stirrer elements that have been pivoted against one another.

If the spring means is embodied as a leg spring, in particular the cross-section minimization explained above can be further enhanced since the leg spring can be installed lying radially on the outside at the stirrer elements, with the smallest possible radial projection.

Preferably, one leg of the leg spring is supported above the pivot bearing at the stirrer element carrier and the other leg of the leg spring is supported at the stirrer element.

In a further advantageous embodiment, the spring means is embodied as a coil spring, which requires an installation space that is as small as possible. For example, one end of the coil spring may be arranged at a pivot piece of the pivot bearing and the other end may be arranged at the stirrer element.

If the spring means is embodied as an electrical link between the stirrer element carrier and the stirrer element, a secure electrostatic deflection that is independent of the fashion in which the pivot bearing is embodied from the liquid to be stirred up via the stirrer elements into the stirrer element carrier can be effected.

It is particularly advantageous if the spring means is made of an electrically conductive plastic, wherein, in a particularly preferred embodiment, the stirring staff arrangement can be implemented, as a whole with all its components, to be manufactured from plastic, preferably electrically conductive plastic.

If the spring means is formed from a material extension embodied at the stirrer element, it is possible to realize the spring means together with the stirrer element in a single manufacturing process, for example in an injection molding process. Additionally, an integral coupling link between the spring means and the stirrer element hereby has been realized, such that special coupling means embodied separately can be spared.

This is also true for the coupling of the spring means to the stirrer element carrier if the spring means, with a free connection end, is coupled to the stirrer element carrier in a form-fitting fashion, for example via a snap-lock.

Regardless of the arrangement of a spring means at the stirring staff arrangement, it turns out to be advantageous in the context of a stirring staff arrangement of the afore-mentioned type if the stirrer elements are made of electrically conductive plastic.

Regardless of the arrangement of a spring means at the stirring staff arrangement, it turns out to be advantageous if the stirrer elements have a bearing end and a stirrer element end coupled to the bearing end via a land and embodied with a flow pipe, wherein the flow pipe has a pipe wall.

Due to the stirrer element end being embodied with a flow pipe, a stabilization of the stirrer element end, which rotates in a flow fluid upon a rotation, is brought about in the flow direction.

If the pipe wall is embodied in such a manner that, in a section perpendicular to the longitudinal axis of the land above a pipe axis, the length of the pipe wall is greater in the flow direction than below the pipe axis, a longer surface profile is embodied above the pipe axis than below the flow axis, such that the uplift acting on the stirrer element ends is raised and a stabilization of the stirrer element ends in the liquid flow during operation is the result.

If additionally a surface underside of an uplift face formed by an upper part of the pipe wall is inclined at an angle of incidence relative to the approach flow direction, via selecting the angle of incidence as a function of the rotation speed of the stirring staff arrangement, a desired uplift force can be set at the stirrer element ends. Thus, it is for example possible to adapt the stirring staff arrangement in a special fashion, by suitably selecting the angle of incidence, to the viscosity or other material properties of the liquids to be stirred up.

Preferably, the pipe wall is embodied as a sloping cone, in such a manner that a flow entry cross-section of the flow pipe is inclined towards a flow exit cross-section of the flow pipe at a pipe angle, such that it is also possible to influence the uplift force hereby.

If the flow pipe, at a flow entry cross-section, has a stowage edge having an annular stowage face, which adjoins a land surface of the land, it is also possible to set a desired flow resistance of the stirrer element depending on the implementation and size of the stowage face.

It is particularly advantageous if the stowage face is inclined in the approach flow direction by a stowage face angle with respect to the axis of rotation, such that, aside from the surface size of the stowage face, the flow resistance can be set via the stowage face angle.

Preferably, the stowage face hat at least one surface segment, which is inclined by a surface segment angle with respect to a planar subarea of the stowage face, such that, in the manner of a pivoted flap known from aerodynamics or aeronautical engineering, an additional uplift force acting at a defined point can be generated, said force serving to influence the relative arrangement of the stirrer element end in the flow environment.

In particular as a function of the fluid to be stirred, selected angle ranges may turn out to be advantageous for the surface segment angles. Preferably, the surface segment angle $\beta_1$, $\beta_2$ is between 5 and 90°, in particular between 5 and 45°, particularly preferably between 5 and 20°, and in particular between 10 and 15°, particularly preferably 10°.

Depending on the desired direction of action of the special uplift force generated with the aid of the surface segment that is adjusted to an angle of incidence, the surface segment may be inclined against the approach flow direction or in the approach flow direction.

It is particularly advantageous if the surface segment can be changed with respect to its inclination with respect to the planar subarea of the stowage face, such that the uplift effect induced by the surface segment may be adapted to the respective fluid to be stirred with the aid of the stirring staff arrangement.

Preferably, the surface segment is embodied as an annular segment, in such a manner that an outer edge of the surface segment is formed by the peripheral edge of the stowage face and that a coupling edge of the surface segment, in the transition to the subarea, runs tangentially to the flow entry cross-section of the flow pipe.

In particular when an uplift moment is supposed to be generated at the stirrer element end with the aid of the surface segments, it is advantageous if the stowage face has two surface segments, which are preferably arranged so as to face each other.

Preferably, the surface segment angles $\beta_1$, $\beta_2$ have identical amounts.

It may also be advantageous for generating an uplift moment if one of the surface segments is inclined in the approach flow direction and one surface segment is inclined against the approach flow direction.

If an uplift pocket is realized in a middle land portion, having an uplift face, which is inclined in the flow direction by an angle of inclination with respect to the axis of rotation and at an angle of incidence with respect to the approach flow direction, by suitably selecting the angles, the uplift or flow resistance behavior of the stirrer element may be influenced via a corresponding design of the land surface.

Preferably, the stirrer element carrier, at its upper axial end, has a connection means for coupling to the lid, wherein the connection means has an axial stop for resting against a supporting edge embodied in the bottom of a stopper depression embodied in the lid for receiving a bung stopper, which supporting edge limits a through boring embodied in the bottom. Hereby, it is possible that the stirring staff arrangement is coupled to the container with the aid of the lid, regardless of a stirring machine combined with the stirring staff arrangement. In this way, the stirring staff arrangement may also be arranged or remain at a container without a stirring machine inevitably having to be coupled to the stirring staff arrangement.

The above advantageous design of the stirring staff arrangement having the connection means arranged at its upper axial end in this way turns out to be advantageous, regardless of the way in which the rest of the stirrer element carrier is designed, which means in particular regardless of a spring means being arranged between the stirrer elements and the stirrer element carrier, and in particular also regardless of how the stirrer elements are designed.

If the stop of the connection means explained above is formed by a retaining ring received in a retaining ring reception of the connection means, it is, on the one hand, possible to implement the same particularly simply and, on the other hand, the design of the stop as a retaining ring, which rests on the supporting edge, allows for a rotational movement between the stirring staff arrangement and lid if required. Preferably, the retaining ring only rests on the supporting edge at a standstill of the stirring staff arrangement, whereas the retaining ring, during a rotation of the stirring staff arrangement, is in a lifted state from the supporting edge with respect to the lid in order to avoid friction and in particular abrasion arising from friction and in this way potential impurities of the liquid received in the container.

Preferably, the retaining ring reception is embodied as a separate component part, which is coupled to the stirrer element carrier in a form-fitting fashion for embodying the connection means.

Alternatively, it is, however, also possible that the retaining ring reception is embodied so as to be integral with the stirrer element carrier.

It is particularly preferable if the retaining ring reception is formed from a material extension which is embodied at the stirrer element carrier, and which may, for example, be generated by a transformation process at the outline of the stirrer element carrier.

If the stirrer element carrier, at its lower axial end, has a connection means embodied as a shaft collar, for connecting the stirrer elements, wherein the connection means is coupled to the stirrer element carrier in a form-fitting fashion and has bearing journals for coupling to the stirrer elements and for embodying pivot bearings, the stirrer element carrier may be designed particularly simply and the connection means, which is complex by comparison, may be produced separately. The connection means can then be designed at the stirrer element carrier by simply producing the form-fitting coupling link between the connection means and the stirrer element carrier.

It is particularly advantageous if the connection means simultaneously serves coupling purposes to the stirring machine shaft of the stirring machine.

If the connection means is coupled to the stirring machine shaft in a form-fitting manner, this coupling may also be effected without the help of tools in a simple manner.

Preferably, the connection means has a first form-fitting coupling means for transmitting the torque of the stirring machine shaft onto the stirrer elements and a second coupling means for axially retaining the connection means on the stirring machine shaft, such that not only the torque is securely transmitted from the stirring machine shaft onto the stirring staff arrangement through a form-fitting coupling means, but additionally a defined axial relative position between the stirring machine shaft and the stirring staff arrangement is axially secured via a form-fitting coupling means.

Preferably, the stirring staff arrangement is embodied such that it is coupled to the lid and is insertable into a filling opening of a container together with the lid, as a mounting unit, and can be coupled to the container with the aid of a coupling link of the lid with the filling opening of the container, such that a stirring staff arrangement can be combined with a container, being secured in the bond with the container, through a simple replacement of the lid arranged on the filling opening of the container by default with a lid coupled to the stirring staff arrangement as a mounting unit.

Preferably, for securing the coupling link of the lid with the stirring staff arrangement and for embodying a lose-proof bond of the lid with the stirring staff arrangement, the lid is provided with a bung stopper arranged in the stopper depression of the lid, in such a manner that the retaining ring is received in a ring receiving space limited axially on both sides, of the stirring staff arrangement implemented as a mounting unit.

The present invention in particular also relates to a transport and storage container for liquids having a container embodied as an inner container, made of plastic, which has, in an upper bottom wall, a filling opening being closable with the help of a lid for filling the container and, at a front side, an outlet neck for connecting an outlet armature as well as bottom wall, which couples two side walls, one rear wall and one front wall of the container to one another, for supporting the container on a pallet bottom of a transport pallet that is provided with an outer jacket for receiving the container, wherein the lid of the container is provided with a stirring staff arrangement corresponding to the advantageous implementations explained above.

BRIEF DESCRIPTION OF THE DRAWING FIGURES

The invention will be explained in more detail below using the drawings.

In the figures:

FIG. 10 shows the stirrer element arrangement illustrated in FIG. 8 in an operating configuration;

FIG. 11 shows a single stirrer element in a view from above;

DETAILED DESCRIPTION OF THE INVENTION

Figure 1:
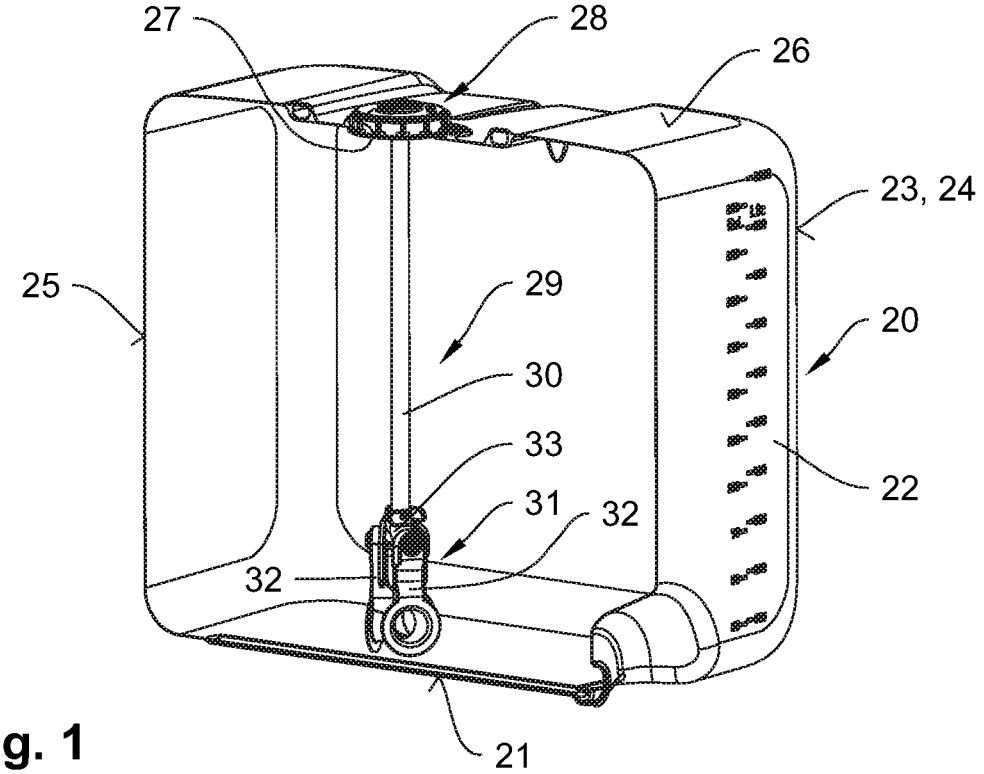
FIG. 1 shows a longitudinal sectional illustration through a container applicable as an inner container for a transport and storage container for liquids, having a stirring staff arrangement in the mounting configuration.

FIG. 1 shows a container 20 for receiving liquids designed as an inner container for a transport and storage container not illustrated in more detail. The container 20, adjoining a lower bottom wall 21, which serves supporting purposes on a pallet bottom not illustrated in more detail here of a transport pallet, which is provided with a grid jacket which is not illustrated in more detail, either, and which receives the container 20, has a front wall 22, two side walls 23, 24 facing each other, one rear wall 25 as well as an upper bottom wall 26 facing the lower bottom wall 21.

The upper bottom wall 26 is provided with a filling neck 27 closable with the help of a lid 28 implemented as a screw cap here.

The lid 28, in the illustrated exemplary embodiment, forms a component of a stirring staff arrangement 29, which has, as essential components, a stirrer element carrier 30 formed as a hollow shaft from electrically conductive plastic in the present case as well as a stirrer element arrangement 31, which, in the case of the present exemplary embodiment, has three stirrer elements 32, which are coupled to the stirrer element carrier 30 with the aid of a shaft collar 33.

Figure 8:
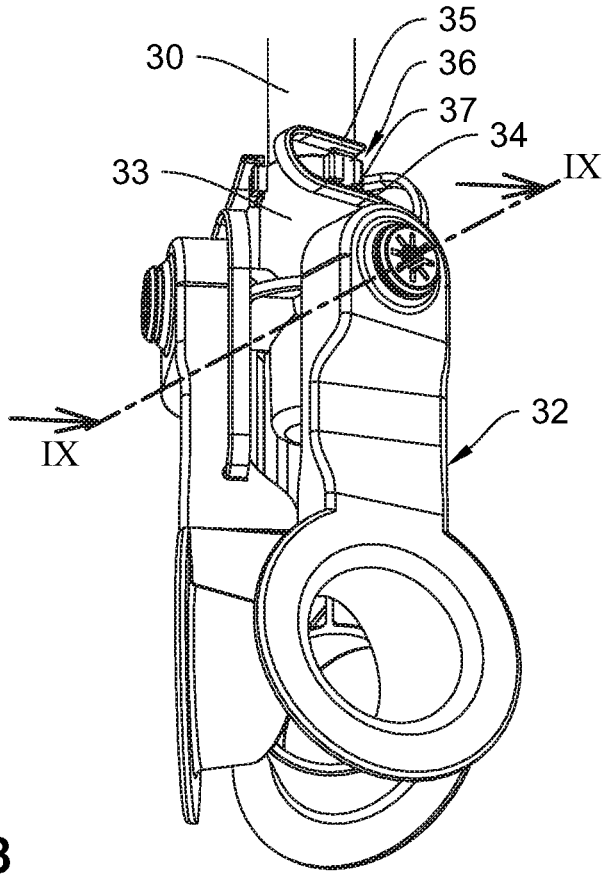
FIG. 8 shows the lower axial end of the stirring staff arrangement illustrated in FIG. 1 in an enlarged illustrated having a plurality of stirrer elements.

As it is apparent in particular from a combined view of FIGS. 1, 8 and 10, spring means, here embodied as leg springs 34, are disposed between the stirrer elements 32 and the stirrer element carrier 30, said spring means, in the present case, being indirectly connected to the stirrer element carrier 30 via the shaft collar 33, wherein the shaft collar, for form-fitting coupling to free leg ends 35 of the leg springs 34, has latching receptions 36, into which latching extension 37 embodied at the leg ends 35 latch. The leg springs 34 are, in the present case, embodied at the stirrer elements 32 so as to be integral, wherein, in the case of the present exemplary embodiment, a form-fitting connection of the leg springs 34 to the stirrer elements 32 is realized in that the stirrer elements 32 have been produced injection molding method together with the leg springs 34. In the pretensioned state, the leg springs are embodied so as to be S-shaped.

The leg springs 34 are formed from an electrically conductive plastic material, like the stirrer elements 32 and the shaft collar 33, consistently with the stirrer element carrier 30.

Figure 2:
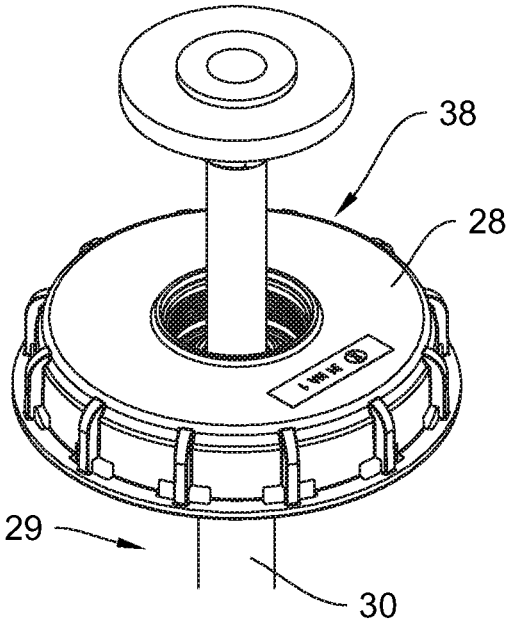
FIG. 2 shows a partial illustration of an upper axial end of the stirring staff arrangement illustrated in FIG. 1, with the stirring machine shaft being in an inserted state.
Figure 5:
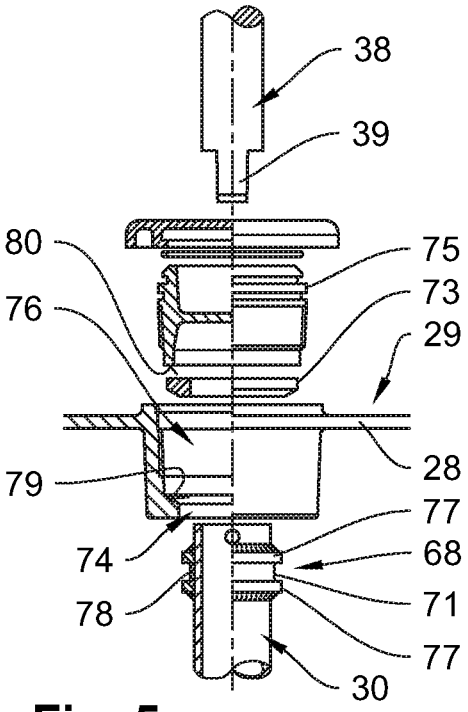
FIG. 5 shows an exploded illustration of a further embodiment of the stirring staff arrangement.
Figure 9:
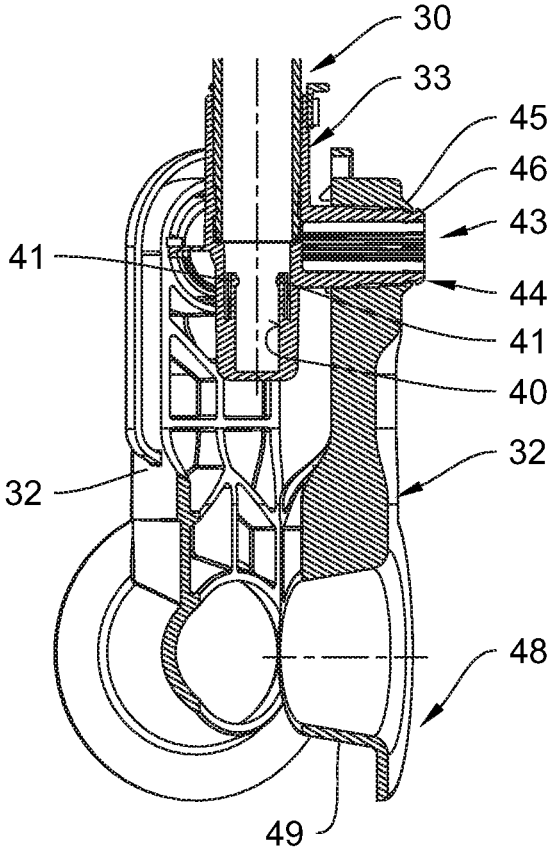
FIG. 9 shows the arrangement of stirrer elements illustrated in FIG. 8, in a sectional illustration in accordance with the line of intersection IX-IX.
Figure 12:
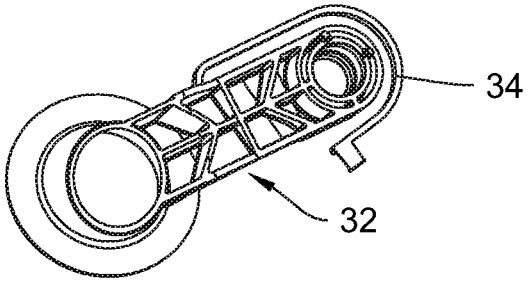
FIG. 12 shows an isometric illustration of the stirrer element illustrated in FIG. 11 in a view from the rear.

In FIGS. 1 and 8, the stirring staff arrangement is illustrated in a mounting configuration, in which the stirrer element carrier 30 does not rotate with the aid of a stirring machine shaft 38 coupled to the stirrer element carrier 30 via the shaft collar 33 in a torsionally stiff fashion, said stirring machine shaft, as it is illustrated in FIG. 2, being introduced from above into the stirrer element carrier 30 and having been introduced into the shaft journal reception 40 illustrated in FIG. 9 and embodied in the shaft collar 33, with the help of a shaft journal 39 illustrated in FIG. 5 and being embodied at the lower axial end of the stirring machine shaft 38. For axially securing the torque transmitting coupling link between the stirring machine shaft 38 and the shaft collar 33, the shaft journal reception 40 is equipped with latching legs 41, which latch into latching receptions not illustrated in more detail at the shaft journal 39.

As shown in particular by a combined view of FIGS. 9 and 10, the stirrer elements 32 are in each instance arranged on a pivot journal 44 embodied at the shaft collar 33, with bearing ends 42 embodied as a bearing lug here, for embodying a pivot bearing 43. The bearing ends 42 are axially secured on the pivot journals 44 via a form-fitting coupling link, in such a manner that a latching shoulder 45 embodied at the bearing ends 42 latches in place behind a latching shoulder 46 of the pivot journals after positioning the stirrer elements 32 on the pivot journals 44.

As a comparison of FIGS. 8 and 10 reveals, in an operating configuration of the stirring staff arrangement 29, in which the stirrer element carrier 30 rotates about an axis of rotation 47 as a consequence of a rotary drive of the stirring machine shaft 38 coupled to the stirrer element carrier 30 via the shaft collar 33, the stirrer elements 32, against the resetting spring force of the leg springs 34, are conveyed into a pivoted position that depends on the rotational speed of the stirrer element carrier 30, with a stirring angle $\delta$ with respect to the axis of rotation 47, in such a manner that stirrer element ends 48 are arranged at a stirring distance r from the axis of rotation 47, said distance being proportional to the stirring angle $\delta$ or to the rotation speed of the stirring machine shaft 38.

Figure 13:
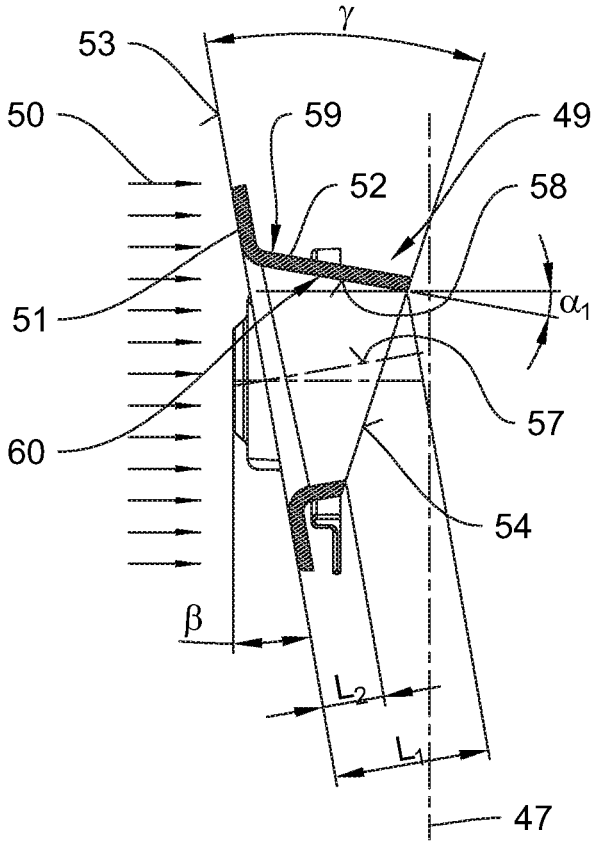
FIG. 13 shows the stirrer element illustrated in FIG. 11 in a sectional illustration in accordance with the line of intersection XIII-XIII.

As shown in particular by a combined view of FIGS. 9, 11 and 13, the stirrer element ends 48 are embodied with a flow pipe, which is provided with an annular stowage face 51 at its flow entry cross-section 53, which means its side facing the approach flow direction 50 upon the stirring procedure. The stowage face 51 is inclined in the approach flow direction 50 with respect to the axis of rotation 47 at a stowage face angle $\beta$. The flow pipe 49 has a pipe wall 52, which is embodied as a sloping cone, in such a manner that the flow entry cross-section 53 is inclined towards a flow exit cross-section 54 of the flow pipe 49 at a pipe angle $\gamma$. Here, as it is illustrated in FIG. 13, in a section perpendicular to a longitudinal axis 55 (FIG. 11) of a land 56 coupling the bearing end 42 of the stirrer element 32 to the stirrer element end 48, above a pipe axis 57, the length L1 of the pipe wall 52 is greater in the flow direction 50 than the length $L_2$ of the pipe wall 52 below the flow axis 57.

As FIG. 13 furthermore shows, a surface underside 58 of a concave uplift face 60 formed by an upper part 59 of the pipe wall 52 is inclined at an angle of incidence $\alpha$ to the approach flow direction 50.

Figure 14:
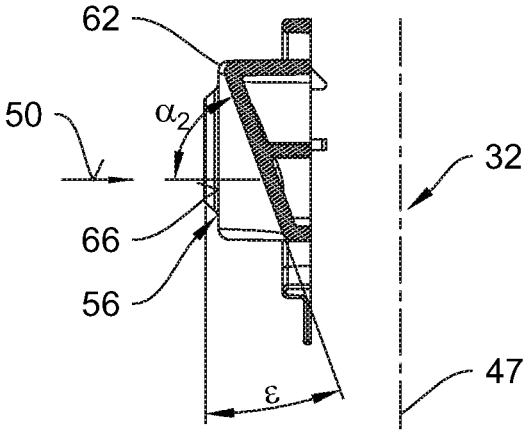
FIG. 14 shows the stirrer element illustrated in FIG. 11 in accordance with the line of intersection XIV-XIV.
Figure 15:
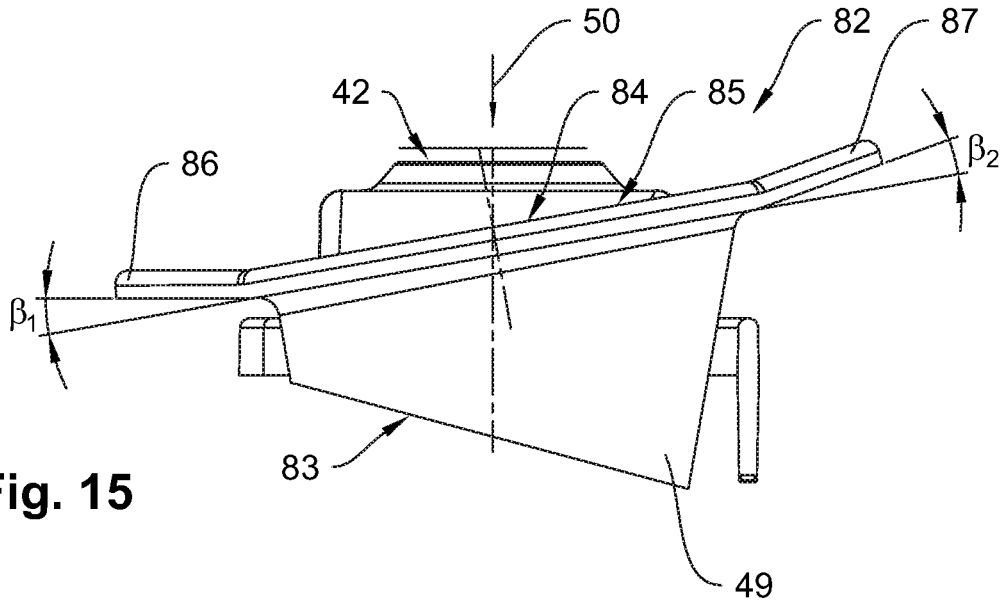
FIG. 15 shows a further embodiment of a stirrer element in a side view.
Figure 16:
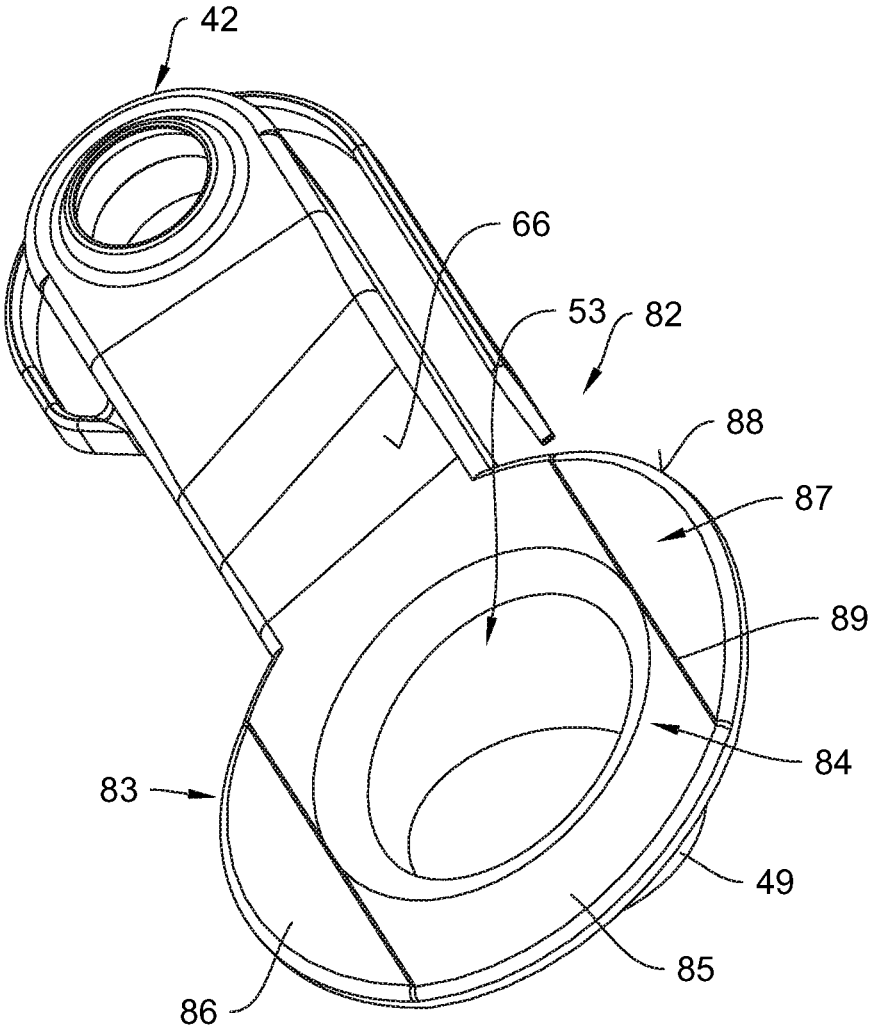
FIG. 16 shows the stirrer element illustrated in FIG. 15 in an isometric illustration.

In FIGS. 15 and 16, a stirrer element 82 is illustrated, which, in contrast to the stirrer element 32 illustrated in particular in FIGS. 13 and 14, has a stirrer element end 83, which, in contrast to the stirrer element end 48 of the stirrer element 82, is provided with a stowage face 84, which is assembled from a planar subarea 85 having surface segments 86 and 87 embodied at the peripheral edge of the stowage face 84, wherein the surface segments 86, 87, in the present case, are in each instance inclined against the approach flow direction 50 by a surface segment angle $\beta_1$ or $\beta_2$ with respect to the planar subarea 85.

As shown in particular by FIG. 16, the surface segments 86, 87 are embodied as annular segments, wherein an outer edge 88 of the surface segments 86, 87 in each instance runs through the peripheral edge of the stowage face 84 and a coupling edge 89 of the surface segments 86, 87, in the transition to the subarea 85, runs tangentially to the flow entry cross-section 53 of the flow pipe 49 of the stirrer element end 83, wherein the coupling edges 89, in the present case, run in a parallel fashion with respect to one another.

The two surface segments, in the case of the illustrated exemplary embodiment, are embodied so as to be planar and additionally have a concurrent size in the present case.

The stirrer element 82 illustrated in FIGS. 15 and 16 is, aside from stirrer element end 83 having stowage face 84 instead of stowage face 51, is embodied in an identical fashion to stirrer element 32 illustrated in FIGS. 13 and 14, such that components of stirrer element 82 that are concurrently embodied correspondingly have concurrent reference numerals.

As shown in particular by a combined view of FIGS. 11 and 14, an uplift pocket 61 is realized in a middle land portion of the land 56, in such a manner that, starting from an approach flow rim 62 of the land 56, running in a substantially straight fashion, an uplift face 63 inclined by the angle of inclination $\varepsilon$ with respect to the axis of rotation 47 and by an angle of incidence $\alpha_2$ with respect to the approach flow direction 50 is realized, said uplift face being lowered with respect to the adjacent land surface 66 via flanks 64, 65 adjusted at an angle of incidence in an oblique fashion with respect to the uplift face.

Figure 4:
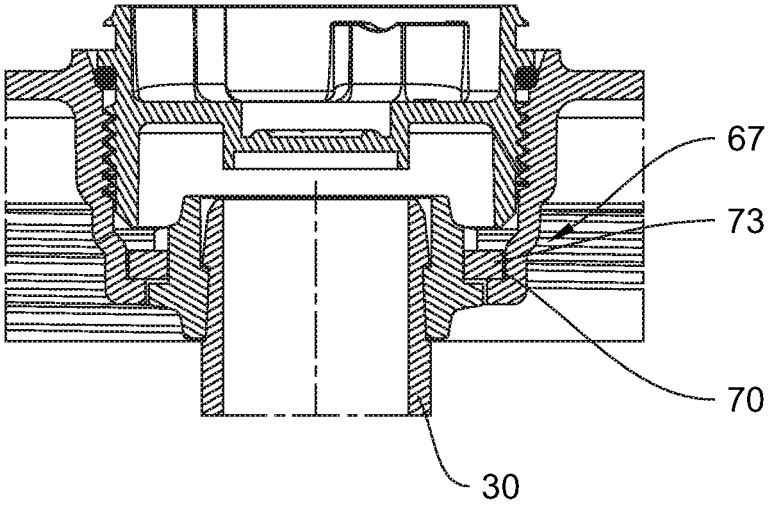
FIG. 4 shows the stirring staff arrangement illustrated in FIG. 1 in a transport state in an enlarged partial sectional illustration.
Figure 6:
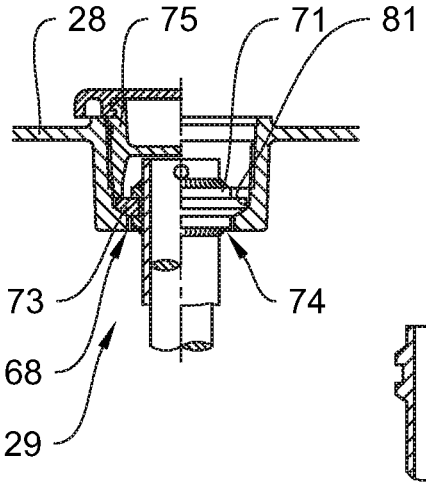
FIG. 6 shows the stirring staff arrangement illustrated in FIG. 5 in the mounted state.
Figure 7:
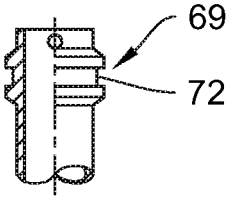
FIG. 7 shows an alternative design of a connection means embodied at the upper axial end of the stirring staff arrangement.

As it is illustrated in particular in FIGS. 4 to 7, the stirrer element carrier 30 of the stirring staff arrangement 29, at its upper axial end, is provided with connection means 67, 68 and 69 which are illustrated in three different implementations here, and which receive, in retaining receptions 70, 71, 72 embodied in different fashions, a retaining ring 73 embodied concurrently in the present case. FIGS. 4 and 6 show the connection means 67 and 68 in the transporting state of the stirring staff arrangement 29. As it is revealed in particular by the connection means 68 shown in FIG. 5 in a partial sectional illustration, the connection means 68 serves to couple the stirrer element carrier 30 of the stirring staff arrangement 29 to the lid 28. Hereunto, the stirrer element carrier 30 illustrated in FIGS. 5 and 6 has a retaining reception 71 embodied as a sleeve and welded to the upper axial end of the stirrer element carrier 30. For mounting, the upper axial end of the stirrer element carrier 30 having the retaining reception 71 realized there is guided from below through a through boring 74 embodied in the lid 28, such that the retaining ring 73 may subsequently be introduced from above into a stopper depression 76 embodied in the lid for receiving a bung stopper 75 and be latched on the retaining reception 71, which has a receiving groove 78 limited by two shoulder lands 77. A relative arrangement between the lid 28 and the connection means 68 results from this, wherein the retaining ring 73 rests against a supporting edge 79 limiting the through boring in the bottom of the lid 28, such that the retaining ring 73 realized an axial stop against the supporting edge 79.

If the bung stopper 75 is now screwed into the stopper depression 76 of the lid 28 from above, a lower edge 80 of the bung stopper 75 limits a ring reception space 81 together with the supporting edge 79 of the lid 28, the retaining ring at best being able to perform a limited or substantially no axial movement in said space, such that a secure coupling link between the lid 28 and the stirrer element carrier 30 is realized.

Figure 3:
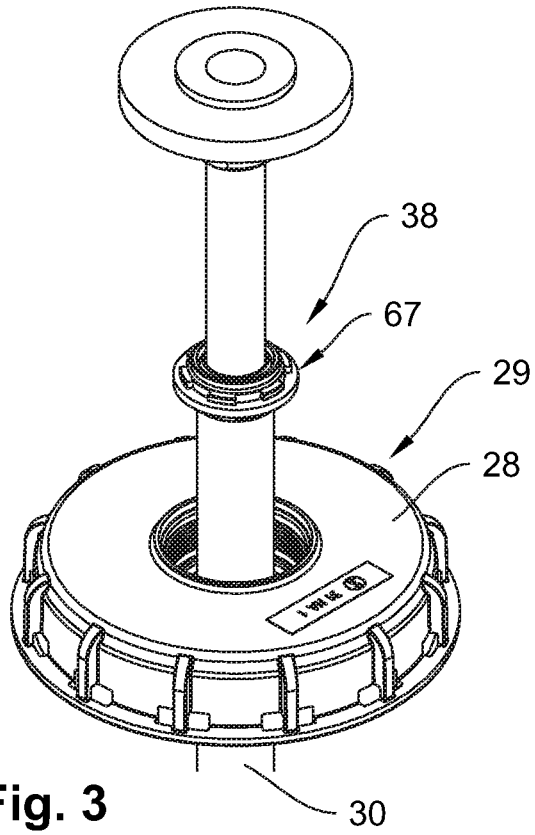
FIG. 3 shows the stirring staff arrangement illustrated in FIG. 2, with the stirring machine shaft being in an axially lifted state.

In this manner, the container 20 may be combined with a stirring staff arrangement 29 regardless of the installation of a stirring machine. If a stirring machine is supposed to be coupled to the stirring staff arrangement 29, in order to stir up a liquid received in the container, it suffices to remove the bung stopper 75 from the stopper depression 76 of the lid 28 and to introduce the stirring machine shaft 38 from above into the stirrer element carrier 30 and to couple it with the same. In this context, the stirring machine may be placed onto the container 20 or onto a load-bearing structure coupled to the outer jacket of the container 20 in the usual manner and be coupled to said structure. Preferably, the stirrer element carrier 30 is in this context slightly lifted axially from the container 20, as it is illustrated in FIG. 3 by way of example, in order to prevent the retaining ring 73 and the supporting edge 79 of the lid 28 from touching during a rotary drive of the stirrer element carrier 30 with the aid of the stirring machine shaft 38 and thus to avoid the formation of any contact abrasion that might impurify the liquid.

The invention claimed is:

1. A stirring staff arrangement (29) for being connected to a stirring machine that can be combined with a container (20) for receiving liquids, wherein the container, in an upper bottom wall (26), has a filling opening being closable with the help of a lid (28) for filling the container, wherein the stirring staff arrangement has a bar-shaped stirrer element carrier (30) embodied as a hollow shaft for receiving a stirring machine shaft (38), and stirrer elements (32, 82) coupled to the stirrer element carrier so as to be pivotable, in such a manner that the stirrer elements have been pivoted, in a mounting configuration, with a free stirrer element end (48, 83), against an axis of rotation (47) of the stirrer element carrier, characterized in that a spring is arranged between the stirrer elements and the stirrer element carrier, in such a manner that the stirrer elements, in an operating configuration, are charged with centrifugal force as a consequence of a rotation of the stirrer element carrier and take a pivoted position that depends on the rotational speed of the stirrer element carrier, a stirring angle $\delta$ being realized with respect to the axis of rotation, wherein the free stirrer element ends are arranged at a stirring distance r from the axis of rotation and the spring force, which increases as the stirring angle grows, opposes the centrifugal force, wherein the stirrer elements (32, 82) have a bearing end (42) and a stirrer element end (48, 83) coupled to the bearing end via a land (56) and embodied with a flow pipe (49), wherein the flow pipe has a pipe wall (52), which extends in an approach flow direction.

2. The stirring staff arrangement according to claim 1, characterized in that the free stirrer element ends (48, 83) of the stirrer elements (32, 82), in the mounting configuration, are arranged below pivot bearings (43) embodied at the stirrer element carrier (30).

3. The stirring staff arrangement according to claim 1, characterized in that the spring is embodied as a leg spring (34).

4. The stirring staff arrangement according to claim 3, characterized in that one leg of the leg spring (34) is supported above the pivot bearing (43) at the stirrer element carrier (30) and in that the other leg of the leg spring is supported at the stirrer element (32, 82).

5. The stirring staff arrangement according to claim 1, characterized in that the spring is embodied as a coil spring.

6. The stirring staff arrangement according to claim 1, characterized in that the spring is embodied as an electrical link between the stirrer element carrier (30) and the stirrer element (32, 82).

7. The stirring staff arrangement according to claim 1, characterized in that the spring is made of an electrically conductive plastic.

8. The stirring staff arrangement according to claim 1, characterized in that the spring is formed from a material extension embodied at the stirrer element (32, 82).

9. The stirring staff arrangement according to claim 1, characterized in that the stirrer elements (32, 82) are made of electrically conductive plastic.

10. The stirring staff arrangement according to claim 1, characterized in that the pipe wall (52) is embodied in such a manner that, in a section perpendicular to the longitudinal axis (55) of the land (56) above a pipe axis (57), the length of the pipe wall is greater in the approach flow direction than below the pipe axis.

11. The stirring staff arrangement according to claim 1 characterized in that a surface underside (58) of an uplift face (60) formed by an upper part (59) of the pipe wall (52) is inclined at an angle of incidence $\alpha_1$ relative to the approach flow direction (50).

12. The stirring staff arrangement according to claim 11, characterized in that the pipe wall (52) is embodied as a sloping cone, in such a manner that a flow entry cross-section (53) of the flow pipe (49) is inclined towards a flow exit cross-section (54) of the flow pipe at a pipe angle $\gamma$.

13. The stirring staff arrangement according to claim 1, characterized in that the flow pipe (49), at its flow entry cross-section (53), has a stowage edge having an annular stowage face (51, 84), which adjoins a land surface (66).

14. The stirring staff arrangement according to claim 13, characterized in that the stowage face (51, 84) is inclined in the approach flow direction (50) by a stowage face angle $\beta$ with respect to the axis of rotation (47).

15. The stirring staff arrangement according to claim 13, characterized in that the stowage face (84) hat at least one surface segment (86, 87), which is inclined by a surface segment angle $\beta_1$, $\beta_2$ with respect to a planar subarea (85) of the stowage face.

16. The stirring staff arrangement according to claim 15, characterized in that the surface segment angle $\beta_1$, $\beta_2$ is between 5 and 90°.

17. The stirring staff arrangement according to claim 15, characterized in that the surface segment angle $\beta_1$, $\beta_2$ is between 5 and 45°.

18. The stirring staff arrangement according to claim 15, characterized in that the surface segment angle $\beta_1$, $\beta_2$ is between 5 and 20°.

19. The stirring staff arrangement according to claim 15, characterized in that the surface segment angle $\beta_1$, $\beta_2$ is between 10 and 15°.

20. The stirring staff arrangement according to claim 15, characterized in that the surface segment (86, 87) is inclined against the approach flow direction (50).

21. The stirring staff arrangement according to claim 15, characterized in that the surface segment is inclined in the approach flow direction (50).

22. The stirring staff arrangement according to claim 15, characterized in that the surface segment can be changed with respect to its inclination with respect to the subarea.

23. The stirring staff arrangement according to claim 15, characterized in that the surface segment (86, 87) is embodied as an annular segment, in such a manner that an outer edge (88) of the surface segment runs through the peripheral edge of the stowage face (84) and that a coupling edge (89) of the surface segment, in the transition to the subarea (85), runs tangentially to the flow entry cross-section (53) of the flow pipe (49).

24. The stirring staff arrangement according to claim 15, characterized in that the stowage face (84) has two surface segments (86, 87).

25. The stirring staff arrangement according to claim 20, characterized in that the surface segments (86, 87) are arranged so as to face each other.

26. The stirring staff arrangement according to claim 24, characterized in that the surface segment angles $\beta_1$, $\beta_2$ have identical amounts.

27. The stirring staff arrangement according to claim 24, characterized in that one of the surface segments is inclined in the approach flow direction and one surface segment is inclined against the approach flow direction.

28. The stirring staff arrangement according to claim 1, characterized in that in a middle land portion of the land (56), an uplift pocket (61) is realized, having an uplift face, which is inclined in the flow direction (50) by an angle of inclination $\varepsilon$ with respect to the axis of rotation (47) and at an angle of incidence $\alpha_2$ with respect to the approach flow direction.

29. The stirring staff arrangement according to claim 1, characterized in that the stirrer element carrier (30), at its upper axial end, has a connection (67, 68, 69) for coupling to the lid (28), wherein the connection has an axial stop for resting against a supporting edge (79) embodied in the bottom of a stopper depression (76) embodied in the lid for receiving a bung stopper (75), which supporting edge limits a through boring (74) embodied in the bottom.

30. The stirring staff arrangement according to claim 29, characterized in that the stop of the connection (67, 68, 69) is formed by a retaining ring (73) received in a retaining ring reception (70, 71, 72) of the connection.

31. The stirring staff arrangement according to claim 30, characterized in that the retaining ring reception (70) is embodied as a separate component part, which is coupled to the stirrer element carrier (30) in a form-fitting fashion for embodying the connection (67).

32. The stirring staff arrangement according to claim 30, characterized in that the retaining ring reception (71, 72) is embodied so as to be integral with the stirrer element carrier (30).

33. The stirring staff arrangement according to claim 32, characterized in that the retaining ring reception (72) is formed from a material extension embodied at the stirrer element carrier (30).

34. The stirring staff arrangement according to claim 1, characterized in that the stirrer element carrier (30), at its lower axial end, has a connection embodied as a shaft collar (33), for connecting the stirrer elements (32), wherein the connection is coupled to the stirrer element carrier in a form-fitting fashion and has bearing journals (44) for coupling to the stirrer elements and for embodying pivot bearings (43).

35. The stirring staff arrangement according to claim 34, characterized in that the connection simultaneously serves coupling purposes to the stirring shaft of the stirring machine.

36. The stirring staff arrangement according to claim 35, characterized in that the connection is coupled to the stirring machine shaft (38) of the stirring machine in a form-fitting fashion.

37. The stirring staff arrangement according to claim 36, characterized in that the connection has a first form-fitting coupling for transmitting the torque of the stirring machine shaft (38) onto the stirrer elements (32, 82) and a second coupling for axially retaining the connection on the stirring machine shaft.

38. The stirring staff arrangement according to claim 34, characterized in that the stirring staff arrangement (29) is coupled to the lid (28), is insertable into a filling opening of a container (20) together with the lid, as a mounting unit, and can be coupled to the container as a mounting unit with the aid of a coupling link of the lid with the filling opening.

39. The stirring staff arrangement according to claim 38, characterized in that for coupling the lid (28) to the stirring staff arrangement (29) and for embodying the mounting unit, the lid is provided with a bung stopper (75) arranged into a stopper depression (76) of the lid, in such a manner that the retaining ring (73) is received in a ring receiving space (81) limited axially on both sides.

40. A transport and storage container for liquids having a container (20) embodied as an inner container, made of plastic, which has, in an upper bottom wall (26), a filling opening being closable with the help of a lid (28) for filling the container and, at a front side, an outlet neck for connecting an outlet armature as well as bottom wall (21), which couples two side walls (23, 24), one rear wall (25) and one front wall (22) of the container to one another, for supporting the container on a pallet bottom of a transport pallet that is provided with an outer jacket for receiving the container, characterized in that the lid is provided with a stirring staff arrangement (29) according to claim 1.

* * * * *